US006681547B1

(12) United States Patent
Wild et al.

(10) Patent No.: US 6,681,547 B1
(45) Date of Patent: Jan. 27, 2004

(54) METHOD FOR HANDLING STAND UP BAGS

(75) Inventors: Hans-Peter Wild, Zug (CH); Eberhard Kraft, Neckarbischofsheim (DE)

(73) Assignee: Indag Gesellschaft fur Industrielbedarf mbH & Co. Betriebs KG, Heidelberg (DE)

( * ) Notice: Subject to any disclaimer, the term of this patent is extended or adjusted under 35 U.S.C. 154(b) by 43 days.

(21) Appl. No.: 09/690,919

(22) Filed: Oct. 17, 2000

(30) Foreign Application Priority Data

Oct. 28, 1999 (DE) ..... 199 52 006

(51) Int. Cl.[7] ..... B65B 61/00

(52) U.S. Cl. ..... 53/410; 53/133.1; 53/544; 53/443; 53/446

(58) Field of Search ..... 53/133.1, 544, 53/410, 443, 446

(56) References Cited

U.S. PATENT DOCUMENTS

| | | | | | |
|---|---|---|---|---|---|
| 2,642,212 | A | * | 6/1953 | Currivan | 198/377.02 |
| 3,139,714 | A | * | 7/1964 | Hall | 53/252 |
| 3,191,748 | A | | 6/1965 | Martin | |
| 3,370,549 | A | * | 2/1968 | Livingston | 104/212 |
| 3,641,737 | A | * | 2/1972 | Tamagni | 53/251 |
| 3,657,860 | A | * | 4/1972 | Franklin | 53/535 |
| 3,987,602 | A | | 10/1976 | Stahl | |
| 4,358,918 | A | * | 11/1982 | Groom et al. | 53/252 |
| 4,614,079 | A | | 9/1986 | Ida et al. | |
| 4,719,741 | A | * | 1/1988 | Mabry | 53/451 |
| 4,800,703 | A | | 1/1989 | Goodman | |
| 4,903,458 | A | * | 2/1990 | Hakansson | 156/443 |
| 5,044,143 | A | * | 9/1991 | Ako et al. | 53/247 |
| 5,123,231 | A | | 6/1992 | Fallas et al. | |
| 5,758,473 | A | * | 6/1998 | Patelli | 222/541.6 |
| 5,778,640 | A | * | 7/1998 | Prakken et al. | 53/244 |

FOREIGN PATENT DOCUMENTS

| | | |
|---|---|---|
| DE | 69502655 | 10/1995 |
| DE | 19745854 | 8/1998 |
| DE | 19745852 | 4/1999 |
| EP | 0 676329 | 5/1998 |
| FR | 2646140 | 10/1990 |

OTHER PUBLICATIONS

Copy of English translation of Japanese Office Action issued Mar. 31, 2003.
Copy of JP 11–193011 (equivalent to 5,979,142 cited above).
Copy of JP 60–148437 (equivalent to 4,572,758 cited above).

* cited by examiner

*Primary Examiner*—Rinaldi I. Rada
*Assistant Examiner*—Hemant M. Desai
(74) *Attorney, Agent, or Firm*—Marshall, Gerstein & Borun LLP

(57) ABSTRACT

Handling stand up bags (2) for beverages, wherein as bags (2) are filled, closed, provided with a drinking straw (3) and, being inserted in a plurality of bags into an outer packaging (4), are discharged, so as to make such a method faster and thus more economic, the stand up bags (2) are transported in a lying position between closing and insertion into the outer packaging (4).

20 Claims, 1 Drawing Sheet

METHOD FOR HANDLING STAND UP BAGS

FIELD OF THE INVENTION

The present invention relates to a method for handling stand up bags.

BACKGROUND OF THE INVENTION

Such a method is known from DE 197 45 852 or DE 197 45 854 C1.

Stand up bags are bags which most of the time consist of a plastic film or aluminum foil and are designed such that they form a self-standing bottom on which the finished and filled bag can stand. The bags are prefabricated such that the edge opposite to the self-standing bottom remains open, so that the bag can be filled from this side. The bags are supplied in an upright position in receiving means, i.e. in a hanging or standing state, to a filling means where they are filled and are then closed—still in an upright position—preferably by a welding means which acts on the two open edges, thus compressing and welding the same under heat and pressure. Since stand up bags are able to stand and since receiving devices have to be provided for filling purposes, such stand up bags have always been transported in a standing position until now. It has been believed that the stand up bags in a standing position occupy the least space, thus permitting a maximum transportation speed, i.e. maximum bag throughput.

SUMMARY OF THE INVENTION

However, it has been found out during the development of the method according to the invention that this is not true.

It is therefore the object of the present invention to provide a method with which the conveying speed can be increased in the handling of stand up bags.

Surprisingly enough, it has been found that stand up bags in a lying position can be transported much more efficiently although it would actually have to be expected that lying bags due to their cushion-like bulging shape are unstable and thus require a slower conveying speed. However, according to the invention it has been found that this is not the case and that, quite to the contrary, the transportation of the stand up bags in a lying position permits a considerably increased conveying speed.

Although it is already known from EP 676 329, U.S. Pat. No. 4,614,079, U.S. Pat. No. 4,903,458 or U.S. Pat. No. 5,123,231 to transport packaging with its longitudinal extension in parallel with the transportation surface, this is only true for block-shaped packaging in the case of which the packaging nevertheless rests on a "self-standing bottom", or for cushion-like packaging which is unable to stand and devoid of a self-standing bottom and provided with a symmetrical thickness.

BRIEF DESCRIPTION OF THE DRAWINGS

The method according to the invention shall now be explained in detail with reference to the drawings, in which.

DETAILED DESCRIPTION OF THE PREFERRED EMBODIMENT

Figures 1, 1A, 1B, 1C:
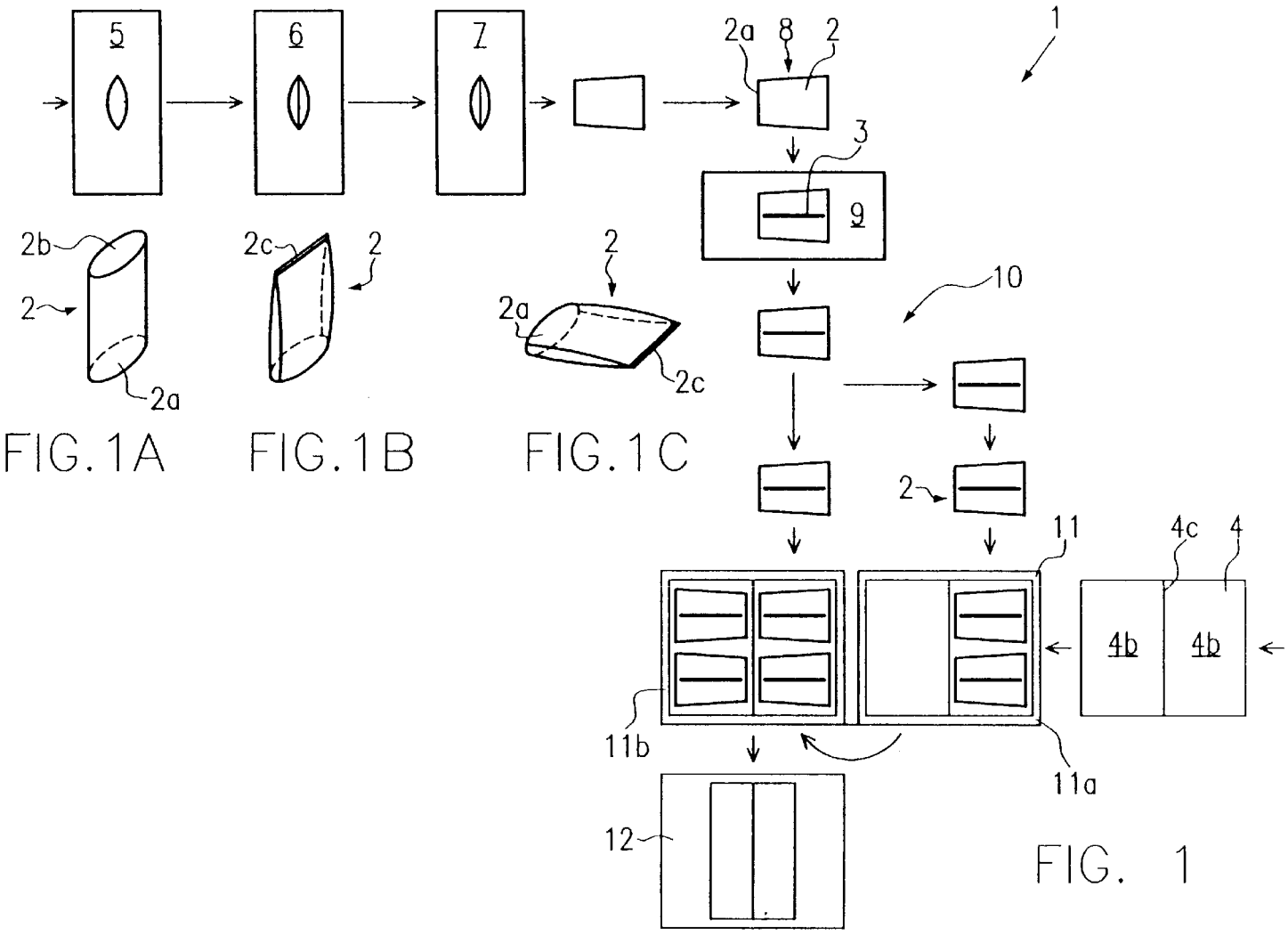
FIG. 1 is a schematic view illustrating an embodiment of a process line for the method of the present invention.
FIGS. 1A–1C are schematic perspective views of the stand up bags in various stages of the method.

FIG. 1 is a top view on a very schematic process line 1 for handling stand up bags 2 that are provided with a drinking straw 3 and packed in a plurality of bags into an outer packaging 4.

In detail, the process line 1 contains a filling station 5 which has supplied thereto already prefabricated bags made from a plastic film or aluminum foil with a self-standing bottom 2*a* and with sides closed on all sides, except for a filling opening 2*b*. In the filling station 5, a beverage is filled, preferably in a hot state, into bags 2. To this end bags 2 are conveyed in the position shown in FIG. 1A, i.e. hanging from clamps with a filling opening 2*b* spread to a maximum degree by clamps or suction means, or the like, or standing inside a receiving means. After the beverage has been filled in, the bag 2 passes into a closing station 6 in which the filling opening 2*b* is sealed, preferably heat-sealed, by connecting the film or foil edges, which define opening 2*b*, with the help of sealing bars or clamps, resulting in the formation of the sealing line 2*c* as shown in FIG. 1B. Subsequently, bag 2 is supplied to a cooling path 7, preferably a water bath, for cooling the beverage that has been filled in in a hot state. In the illustrated embodiment, bag 2 passes through the cooling path 7 in a still upright hanging or standing position. After having left the cooling path 7, bags 2 are brought by suitable grippers, or the like, into the lying position shown in FIG. 1C, in which they are lying on one of their cushion-curved side surfaces and are continuously passed on. The orientation of the bag 2 relative to the conveying direction, which is illustrated by the continuous series of arrows, is here changed so that, as can be seen at the transfer point 8, the longitudinal extension of the bag 2 is now oriented in a direction transverse to the conveying direction, with all of the bags 2 being oriented with their self-standing bottoms 2*a* in the same direction and aligned in parallel with the current conveying direction. In said position, the bags 2 pass through an attaching station 9 for attaching drinking straws 3 to the upwardly oriented side surface of each bag 2.

In the conveying direction downstream of the attaching station 9, the bags pass through a further transfer point 10 where the previously single row of bags is divided into two parallel rows, but where the orientation of the bags is not changed. Subsequently, the bags are transported into a packaging station to pack them into the outer packaging 4. The outer packaging 4 contains two compartments 4*a* and 4*b* that are interconnected via a bending fold 4*c*.

The packaging station contains two partial stations 11*a* and 11*b* where in the partial station 11*a* bags 2 are packed into the compartment 4*a* of the outer packaging 4 and in the partial station 11*b* bags 2 are packed into the compartment 4*b* of the outer packaging 4. Packaging 4 first passes into the first partial station 11*a* in which bags 2 are conveyed under the action of gravity into compartment 4*a* until the latter is filled with a predetermined number of bags. The self-standing bottoms 2*a* of the bags are oriented towards the bending fold 4*c*.

After compartment 4*a* has been filled, the packaging 4 is turned by 180° about a vertical axis and supplied to the second partial station 11*b* in which bags 2 are inserted in the same way into compartment 4*b*. Since the packaging has been rotated or turned, the bags 2 in both compartments are oriented with their self-standing bottoms 2*a* towards the bending fold 4*c*, facing outwards with the same sides, so that after the outer packaging 4 has passed through a folding station 12, in which the compartments are folded around the bending fold 4*c* onto each other and the outer packaging is closed, identical surface portions of the bags, e.g. with printed information on their contents, are oriented outwards and are visible through windows or recesses in the outer packaging 4.

In a modification of the described and illustrated embodiment the closed bag can e.g. pass through the cooling path in an already lying position. Conveyor belts or other suitable conveying means may be used for transportation. The bags may be packed in another way than shown and/or into other outer packaging and/or from a single row.

We claim:

1. A method for handling stand up bags for beverages comprising the steps of:

filling each of the bags with a liquid beverage, closing each of the bags, attaching a separate drinking straw to an exterior of each of the bags, inserting a plurality of the bags into an outer packaging, transporting each of the bags in a lying and non-stacked position between said steps of closing and inserting, and discharging the outer packaging and the bags.

2. The method according to claim 1, and, after the step of closing, cooling the bags, and transferring the bags into a lying position.

3. The method according to claim 1 or 2, and, prior to the step of inserting the bags into the outer packaging, attaching the drinking straw to the lying bags.

4. The method according to claim 1 or 2, and inserting the bags in a lying state from a lying conveying position into the outer packaging.

5. The method according to claim 1 or 2, and conveying the bags in a lying position in a direction transverse to the longitudinal extension thereof.

6. The method according to claim 1, and, before being packed, conveying the bags in a lying position and with a uniform orientation that is the same for all bags.

7. A method for handling stand up bags (2) for beverages, including making a bag (2) from a film or foil, closing the bag on the periphery and providing the bag with a self-standing bottom (2*a*), filling the bag in an upright position through an opening (2*b*) which is opposite to the self-standing bottom (2*a*) and defined by film or foil edges, closing the bag (2) in the upright position by welding the film or foil edges defining the opening (2*b*), resulting in the formation of a stand up bag (2) with cushion-curved bulging side surfaces, attaching to the bags (2) a drinking straw (3), inserting a plurality of bags into an outer packaging (4), and discharging the outer packaging and the bags, the improvement comprising the steps of, after closing and prior to attaching the drinking straw (3), transferring the stand up bags (2) into a lying position in which they are transported in a direction transverse to the longitudinal extension thereof with self-standing bottoms (2*a*) oriented towards the same side, through an attaching station (9) for attaching the drinking straw (3) until insertion into the outer packaging (4), and inserting the bags from the lying conveying position in a lying state into the outer packaging (4).

8. The method according to claim 7, and, after closing the bags (2), the steps of cooling the bags, and transferring the bags into the lying position.

9. The method according to claim 7 or 8, wherein the respective steps of filling, closing, transferring into a lying conveying position, attaching the drinking straw (3), and inserting into an outer packaging (4), are carried out in a continuous process line (1).

10. A method for handling stand up bags for beverages comprising the steps of:

filling the bags with a liquid beverage, closing the bags, providing an exterior of each of the closed bags with a drinking straw, inserting a plurality of bags into an outer packaging, bringing each of the bags one by one to a lying position between said steps of closing and inserting, changing a feeding direction of the bags between the steps of closing and inserting from a first direction in which a bottom of each bag extends transversely to the first direction to a second direction where the bottom of each bag extends parallel to the second direction, feeding the bags into the outer packaging while in the second direction, and discharging the outer packaging and the bags.

11. The method according to claim 10, and, after the step of closing, cooling the bags, and transferring the bags into a lying position.

12. The method according to claim 10, and, prior to the step of inserting the bags into the outer packaging, attaching the drinking straw to the lying bags.

13. The method according to claim 10, and inserting the bags in a lying state from a lying conveying position into the outer packaging.

14. The method according to claim 10, and, before the step of inserting, conveying the bags in a lying position and with a uniform orientation that is the same for all bags.

15. A method for handling stand up bags for beverages comprising the steps of:

filling the bags with a liquid beverage, closing the bags, providing an exterior of each of the closed bags with a drinking straw, individually transporting the bags in a lying position after the step of closing, separating the bags into a first row and a second row, inserting the bags into a first and second compartment of an outer packaging, and discharging the outer packaging and the bags.

16. The method according to claim 15, and, after the step of closing, cooling the bags, and transferring the bags into a lying position.

17. The method according to claim 15, and, prior to the step of simultaneously inserting the bags, attaching the drinking straw to the lying bags.

18. The method according to claim 15, and inserting the bags in a lying state from a lying conveying position into the outer packaging.

19. The method according to claim 15, and conveying the bags in a lying position in a direction transverse to the longitudinal extension thereof.

20. The method according to claim 15, and, before the step of simultaneously inserting the bags, conveying the bags in a lying position and with a uniform orientation that is the same for all bags.

* * * * *

UNITED STATES PATENT AND TRADEMARK OFFICE

CERTIFICATE OF CORRECTION

PATENT NO. : 6,681,547 B1
DATED : January 27, 2004
INVENTOR(S) : Hans-Peter Wild et al.

It is certified that error appears in the above-identified patent and that said Letters Patent is hereby corrected as shown below:

Title page,
Item [73], Assignee, please delete "fur Industrielbedarf" and replace with -- für Industriebedarf --.

Signed and Sealed this

Fifteenth Day of February, 2005

JON W. DUDAS
*Director of the United States Patent and Trademark Office*